United States Patent [19]

Johnston

[11] Patent Number: 4,766,831

[45] Date of Patent: Aug. 30, 1988

[54] RIGGING FOR A WIND PROPELLED CRAFT

[76] Inventor: Patrick M. Johnston, 57 Solomon St., Palmyra, Western Australia, Australia, 6157

[21] Appl. No.: 906,232

[22] PCT Filed: Jan. 9, 1986

[86] PCT No.: PCT/AU86/00005

§ 371 Date: Sep. 11, 1986

§ 102(e) Date: Sep. 11, 1986

[87] PCT Pub. No.: WO86/04034

PCT Pub. Date: Jul. 17, 1986

[30] Foreign Application Priority Data

Jan. 14, 1985 [AU] Australia ..... PG8868

[51] Int. Cl.[4] ..... B63H 9/06

[52] U.S. Cl. ..... 114/102; 114/103

[58] Field of Search ..... 114/39, 39.1, 90, 91, 114/102, 103, 105, 106

[56] References Cited

U.S. PATENT DOCUMENTS

| | | | |
|---|---|---|---|
| 2,107,303 | 2/1938 | Ljungstrom | 114/106 |
| 2,561,253 | 7/1951 | Wells-Coates | 114/103 X |
| 2,569,318 | 9/1951 | Kersten | 114/112 |
| 3,132,620 | 5/1964 | Court | 114/106 X |
| 4,064,821 | 12/1977 | Roberts, Jr. et al. | 114/102 X |
| 4,369,726 | 1/1983 | Mader | 114/103 X |
| 4,386,574 | 6/1983 | Riolland | 244/219 X |

FOREIGN PATENT DOCUMENTS

| | | |
|---|---|---|
| 3852178 | 2/1980 | Australia . |
| 8661182 | 2/1983 | Australia . |
| 8938182 | 4/1983 | Australia . |
| 2544690 | 4/1983 | France . |
| 2541230 | 8/1984 | France . |
| 8500116 | 9/1985 | PCT Int'l Appl. . |
| 680553 | 10/1949 | United Kingdom . |
| 1117529 | 6/1968 | United Kingdom . |
| 2085387 | 4/1982 | United Kingdom . |

*Primary Examiner*—Sherman D. Basinger

*Attorney, Agent, or Firm*—Reising, Ethington, Barnard, Perry & Milton

[57] ABSTRACT

The invention is a rigging (9) for a wind propelled craft (8). The rigging (9) comprises a flexible sail (10) of two substantially identical flexible sail portions (80, 82) each having a leach (18) and a luff (20). Elongated battens (92) are in contact with the flexible sail portions (80, 82). A control rod (32) has the battens (92) and luffs of the sail portions (80, 82) rotatably attached so that the perpendicular distance between the sail portions (80, 82) varies wherein angular displacement of the control rod (32) with respect to the boom causes the battens (92) to be compressed along their length so as to bend one of the sail portions (80) to increase the camber thereof and causes the battens (92) of the other sail portions (82) to be tensioned along their length so as to partly straighten the other sail portion (82) which decreases the perpendicular distance between the sail portions (80, 82) resulting in asymmetry of the aerofoil.

5 Claims, 8 Drawing Sheets

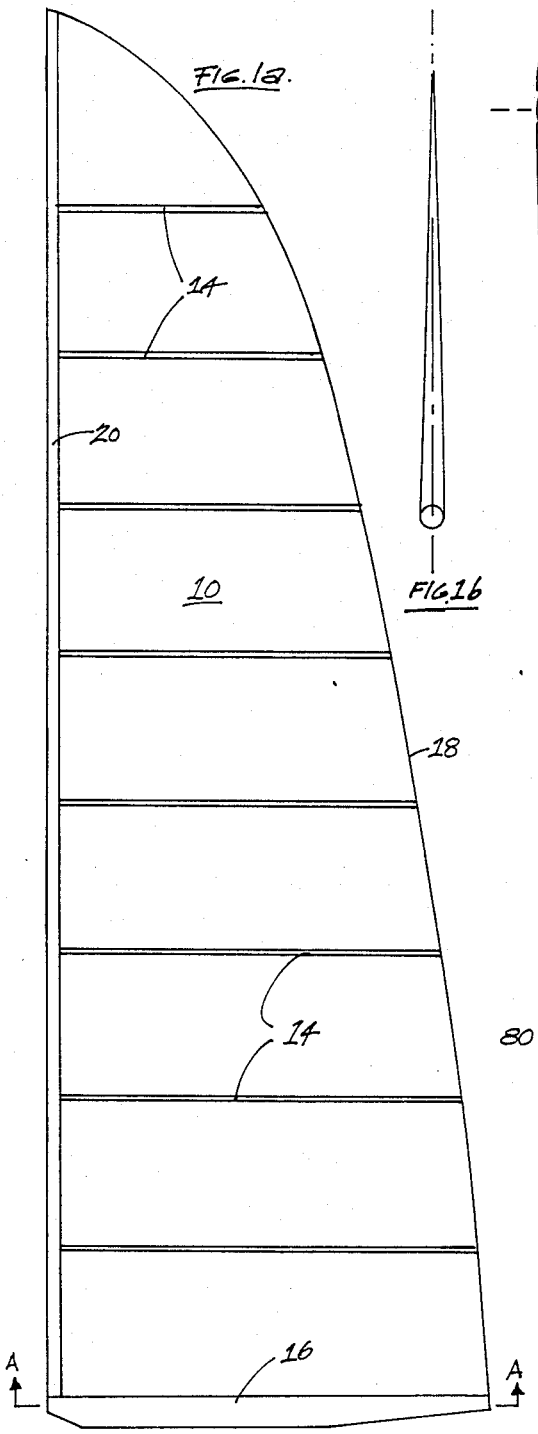
FIG. 1a.
14
20
10
18
14
16
A
A
FIG. 1b
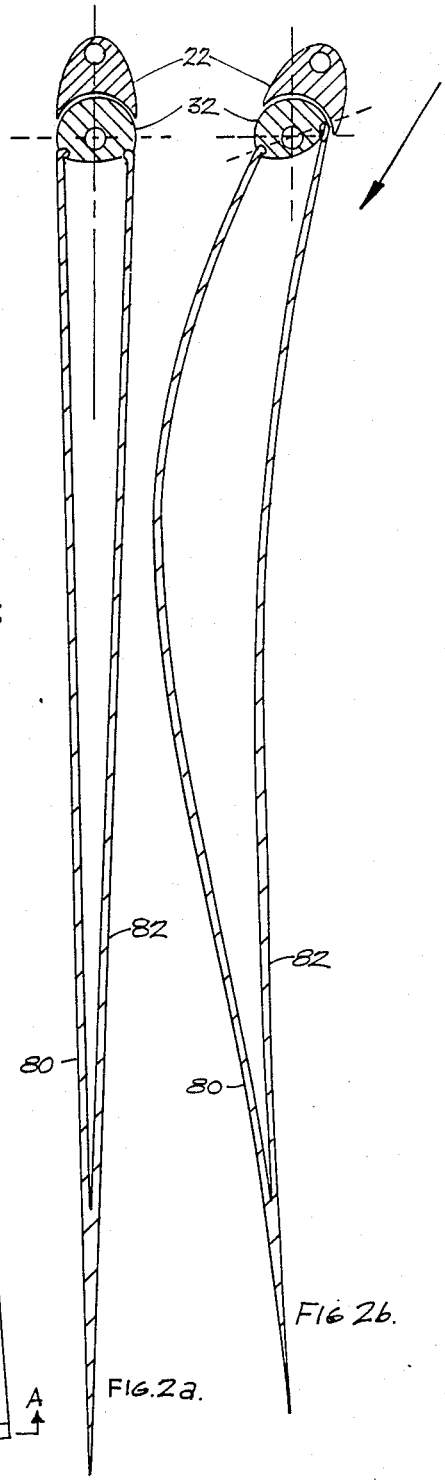
22
32
82
80
82
80
FIG. 2a.
FIG 2b.

RIGGING FOR A WIND PROPELLED CRAFT

DESCRIPTION

The present invention relates to rigging for a wind propelled craft.

The apparatus of the present invention will hereinafter be described with particular reference to wind propelled craft being sailing vessels, such as for example 18 foot skiffs, although it is to be understood that it is of general applicability.

FIELD OF THE INVENTION

In general, sails used to propel sailing vessels are either relatively thin, compared to their length, or comprise fixed symmetric aerofoils such as in recent international C class catamarans.

In the former case the sail creates forward drive by an aerofoil action produced by stagnation of air at the leach of the sail and at the mast on the windward side thereof. The stagnation leads to a net circulation of air about the sail. The drive produced by the sail is dependent upon the amount of circulation. Such sails are relatively inefficient since they are thin and can only create a small amount of circulation of air about the sail. In the latter case the portion of the sail which is the fixed symmetric aerofoil serves to increase the circulation of air about the sail. Thus, a part fixed symmetric aerofoil sail gains drive indirectly from the aerofoil. Similarly, drive can be produced by a sail formed of several fixed symmetric aerofoils pivotally attached at in line at their respective forward and trailing edges.

It has been found that an efficient sail can be formed from a single fixed aerofoil having a particular shape. The actual aerofoil shape is dependent upon the conditions of its use. However, a fixed asymmetric aerofoil is required. Thus, a sailing vessel having such a sail could only be operated on a port or a starboard board but not both.

SUMMARY OF THE INVENTION

The present invention provides rigging for a wind propelled craft employing an asymmetrical aerofoil sail which can be used to propel a vessel on both port and starboard boards.

In accordance with one aspect of the present invention there is provided rigging for a wind propelled craft, the rigging (a) characterised in that it comprises a flexible sail comprising two substantially identical flexible sail portions each having a leach and a luff, the flexible sail portion being arranged to give the flexible sail an effective thickness substantially greater than that of either of the flexible sail portions individually and a pocket means arranged to receive an elongated batten having flexure in at least two dimensions, the elongated batten comprising two substantially elongated batten portions each having a first free end and a second end, the second ends being arranged to be connected together adjacent the leach of the flexible sail portions, the elongated batten portions being splayed apart and extending toward the luff of the flexible sail portions, a spar connected to the luff of the flexible sail portions and having a control means to vary the thickness of the flexible sail such that the craft may be propelled by wind incident at various angles of attack to the spar.

In accordance with a further aspect of the present invention there is provided a flexible sail, characterised in that it comprises two substantially identical flexible sail portions arranged to give the flexible sail an effective thickness substantially greater than that of either of the flexible sail portions individually so that, in use, the flexible sail may be controlled by a rigging to conform to an asymmetric aerofoil shape.

In accordance with a still further aspect of the present invention there is provided an elongated batten, characterised in that it has flexure in at least two dimensions and comprises two substantially identical elongated batten portions each having a first free end and a second end, the second ends being arranged to be connected together and the elongated batten portions being splayed apart and extending in the same general direction towards their first ends, each of the elongated batten portions being arranged, in use, to be inserted into a pocket means of a flexible sail comprising two substantially identical flexible sail portions arranged to give the sail an effective thickness substantially greater than that of either of the flexible sail portions individually.

In accordance with a still further aspect of the present invention there is provided a spar for a wind propelled craft, characterised in that the spar has a leading edge and a trailing edge and means to vary the thickness of a flexible sail comprising two substantially identical flexible sail portions each having a leach and a luff and which are joined at their leach and connected to the trailing edge of the spar at their luff.

BRIEF DESCRIPTION OF THE DRAWINGS

The present invention will now be described by way of example with reference to the accompanying drawings, in which:

FIG. 1*a* is a side view of a flexible sail and spar of the rigging of FIG. 1, in accordance with the present invention;

FIG. 1*b* is a cross-sectional view of the flexible sail of FIG. 1*a* along the line A—A;

FIG. 2*a* is an enlarged representation of the view of FIG. 1*b;*

FIG. 2*b* is a representation of the flexible sail of FIG. 1*a* shown for a starboard board;

BRIEF DESCRIPTION OF THE INVENTION

Figure 1:
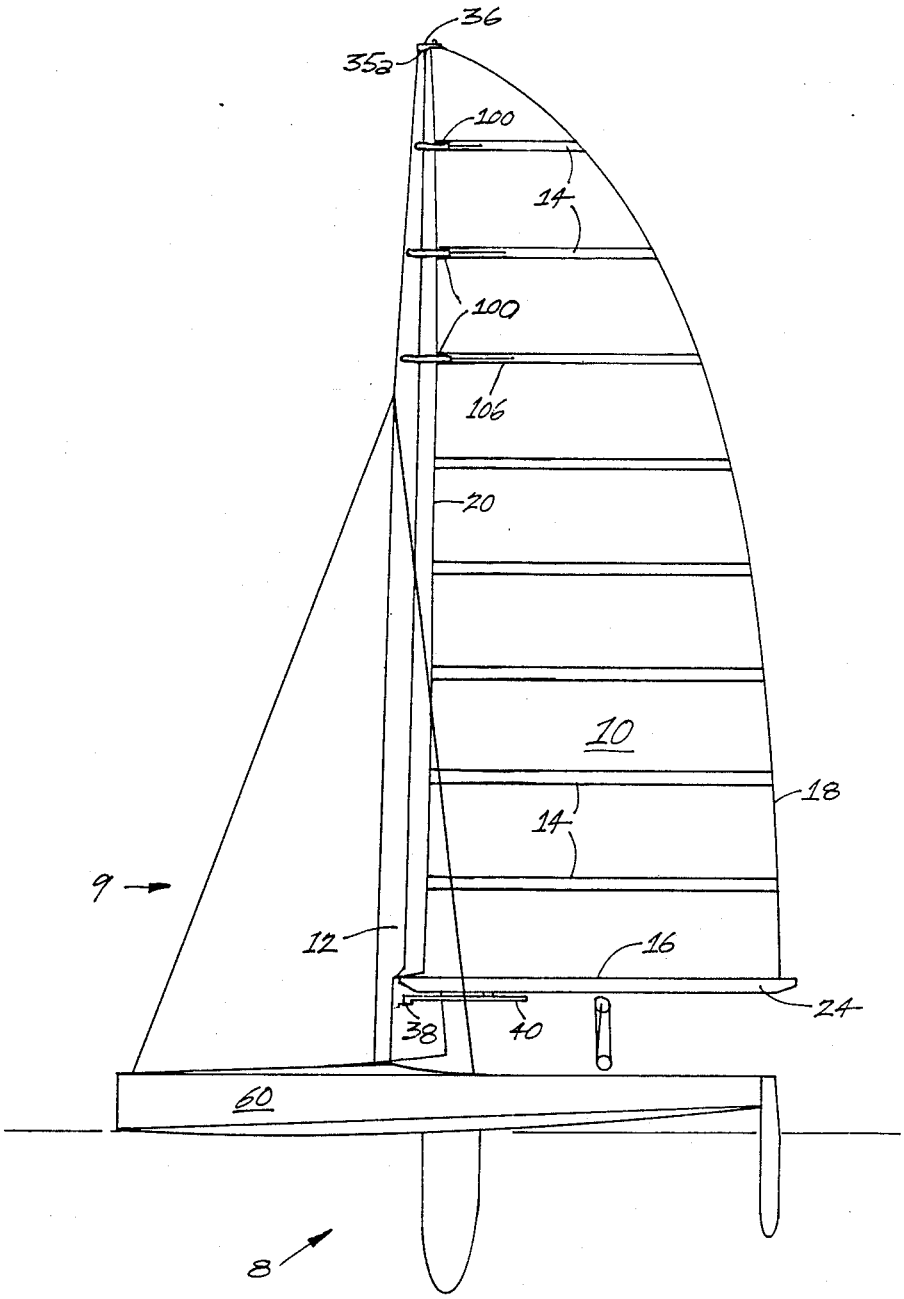
FIG. 1 is a side view of a sailing vessel having rigging comprising a sail and a spar in accordance with the present invention.

In FIG. 1 there is shown a sailing vessel 8 having rigging 9 comprising a flexible sail 10 and a spar 12 (See FIG. 1*a*).

The sail 10 comprises a plurality of transversely extending pocket means 14 disposed substantially horizontally in respective sail portions as will be described. The sail 10 also comprises a foot 16, a leach 18 and a luff 20.

Figure 3:
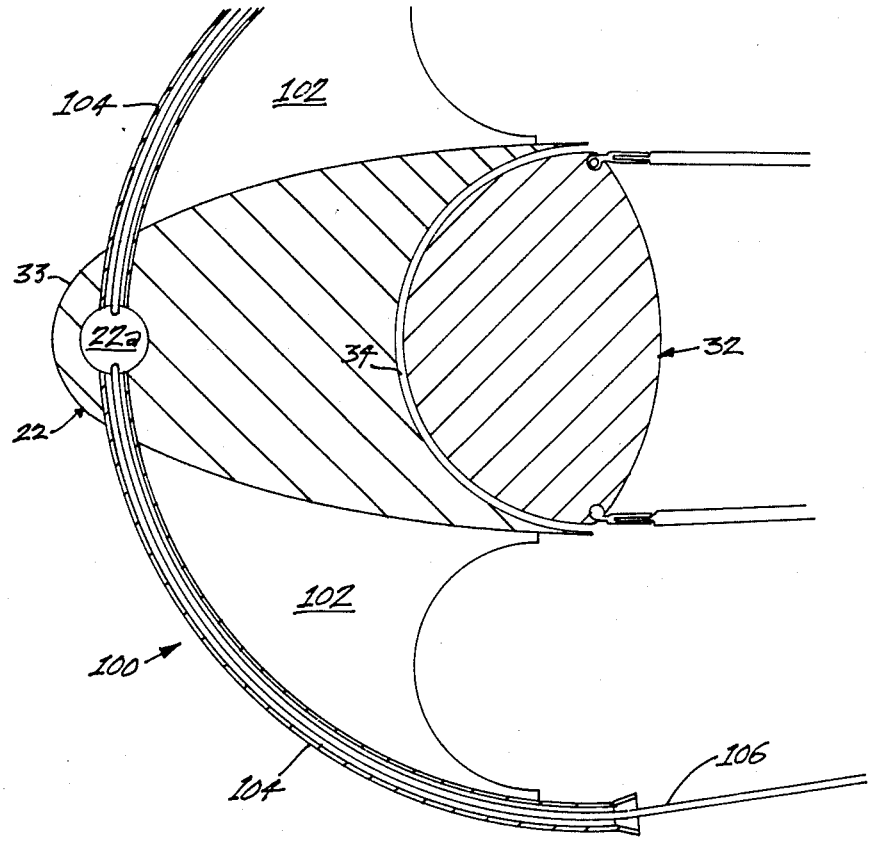
FIG. 3 is a schematic cross-sectional view of the spar of FIG. 1*a,* including winglettes.

The spar 12 comprises a mast 22 and a boom 24 and a control rod 32 as shown in FIGS. 1, 2a, 2b and 3. The mast 22 comprises a leading edge 33 and a trailing edge 34, as shown in FIG. 3 and a masthead 35a (see FIGS. 3a and 3b) and a gooseneck 35b (see FIGS. 1 and 4). The control rod 32 comprises a location pin 32a, in use, arranged adjacent the masthead 35a. The trailing edge 34 defines a concave surface arranged to receive the control rod 32, which control rod 32 is of a complementary cross sectional shape adjacent the trailing edge 34 and extends substantially the length of the mast 22.

The mast 22 comprises a hollow tube 22a located adjacent the leading edge 33 and running substantially the entire length of the mast 22. The tube 22a is intended to receive cordage, such as, for example jib and/or spinnacker halyards and the like.

Figure 3B:
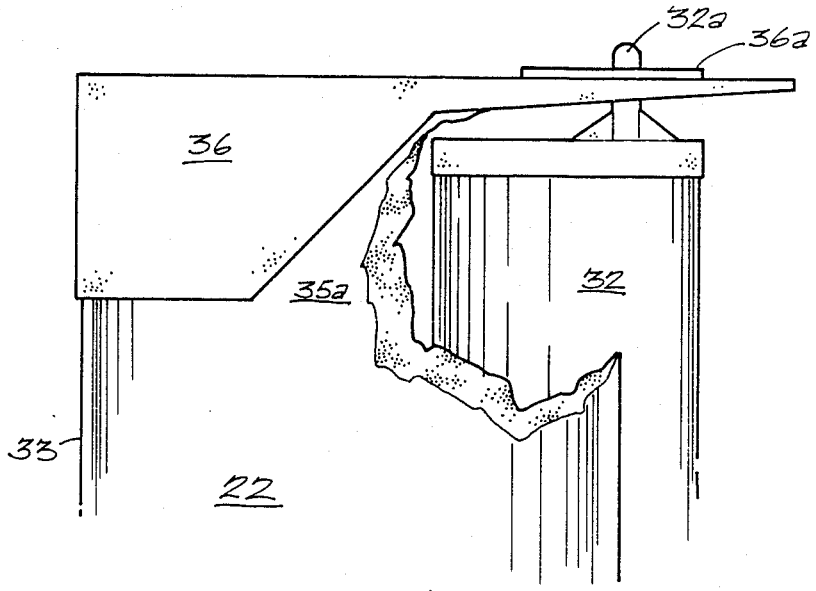
FIGS. 3*a* and 3*b* are plan and side elevations respectively of a masthead fitting of the spar of FIGS. 1*a* and 3.
Figure 3A:
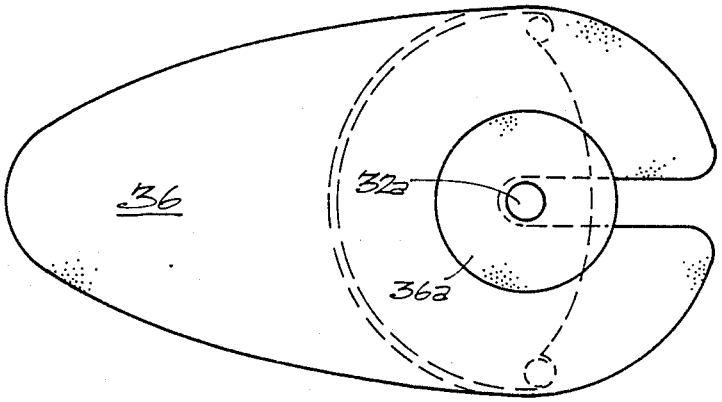

At the mast head 35a there is located a fitting 36 having a slot 36a as shown in FIGS. 3a and 3b arranged to receive the location pin 32a. A cap 36a having a hole arranged to fit around the pin 32a is used to fix the control rod 32 to the mast head 36.

It is intended that the mast 22 and the control rod 32 be substantially inflexible, so that in normal use there is only negligible bending thereof. Such is intended so that a gap may be maintained, in use, between the trailing edge 34 of the mast 22 and the control rod 32. Thence, there is no need to rotatably connect the control rod 32 to the mast 22 except at the mast head 35a and the goose neck 35b. Furthermore, excessive bending could lead to an unfavourable situation wherein the control rod 32 contacts the trailing edge 34 leading to friction therebetween.

Figure 4:
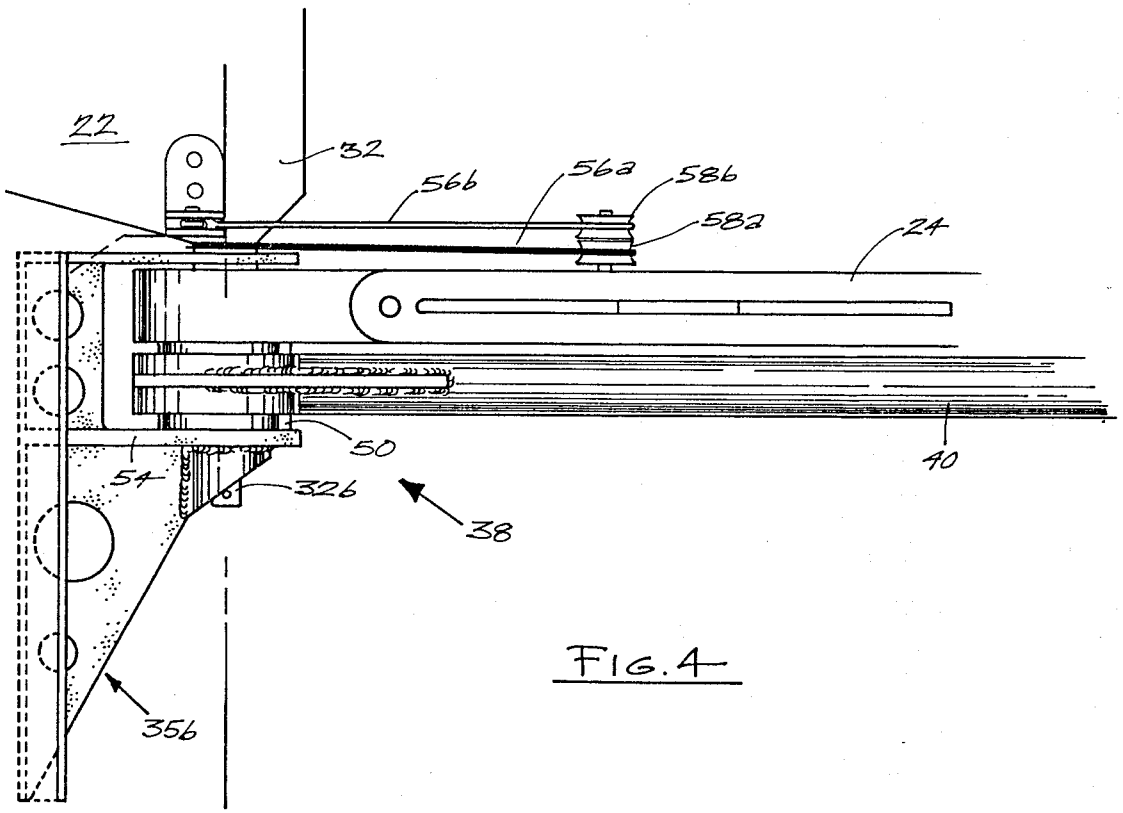
FIG. 4 is a side view of a control means in accordance with the present invention shown in relation to a gooseneck of the mast and a boom of the spar of FIG. 1*a;*
Figure 5:
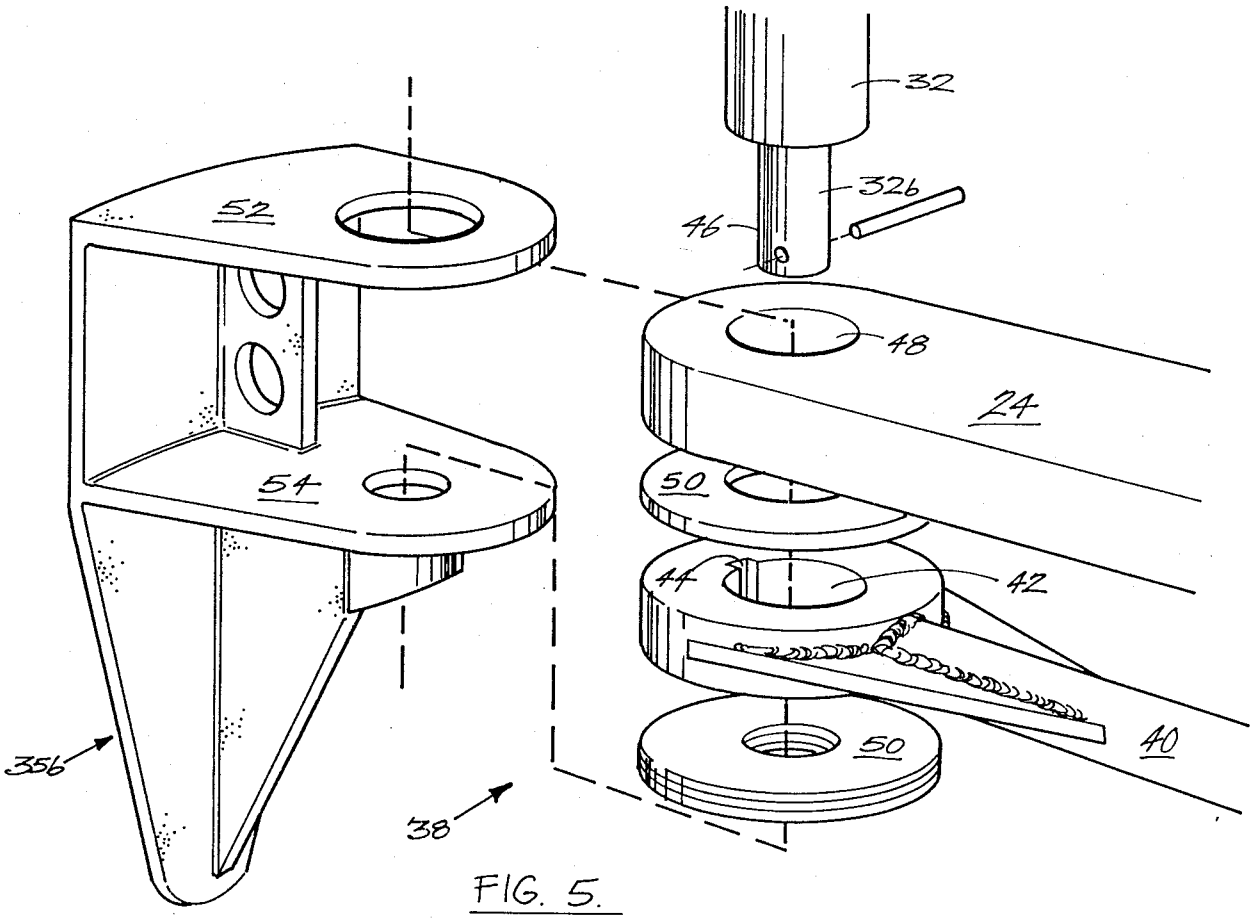
FIG. 5 is an exploded upper perspective view of the apparatus of FIG. 4.

In order to obtain savings in weight and the preferred inflexibility the mast 22 may be made from balsa wood reinforced with a high tensible fabric such as kevlar and located with a two part epoxy resin. The mast 22 may also be partially hollow although, it is preferred that the mast 22 be buoyant and hermetically sealed. The control rod 32 comprises a location rod 32b remote from the location pin 32a. The location rod 32b is arranged to be located into the gooseneck 35b as shown in FIGS. 4 and 5.

A control means 38 is provided at the gooseneck 35b. The control means 38 comprises a lever 40 having a hole 42 to receive the location rod 32b.

The hole 42 comprises a key way 44 arranged to receive a key 46 of the location rod 32b. The control rod 32 is thus fixed to rotate with the lever 40.

The boom 24 has a hole 48 disposed to also receive the location rod 32b and to be rotatable thereabout. Spacers and/or bearings 50 are provided to reduce friction between the boom 24, lever 40 and flanges 52 and 54 of the gooseneck 35b.

Figure 6:
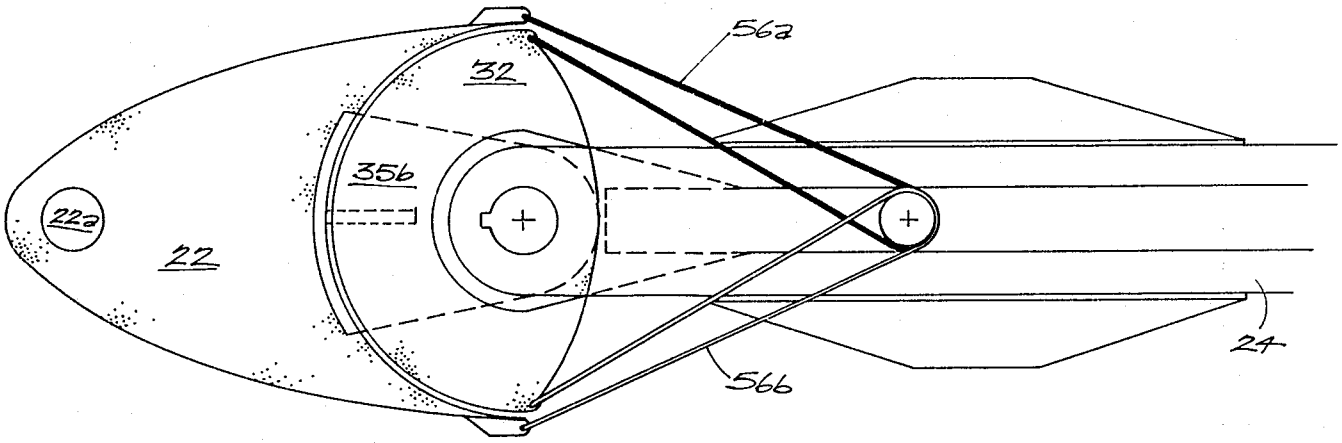
FIG. 6 is a cut away plan view of the apparatus of FIG. 4.

The control means 38 also comprises two cords 56a and 56b each fixed at one end to the mast 22 and the other end to the control rod 32. The cords 56a and 56b pass about respective pulleys 58 and 58b as shown in FIGS. 4 and 6.

The cords operate to maintain the angles of the mast 22 with respect to the boom 24 and the control rod with respect to the boom 24 equal and opposite. Thus, rotation of the lever 40 produces a corresponding rotation of the control rod 32 and an opposite rotation of the mast 22, as depicted in FIG. 2b.

The lever 40 is operated by a series of pulleys and cords (not shown) so that its angle with respect to the boom 24 may be set to a desired angle and adjusted during use.

Furthermore, the mast 22 is stepped onto a hull 60 of the sailing vessel 8 and is controlled in known manner to rotate thereon.

Thus, the lever 40 may be set to an angle with respect to the boom 24 and the angles of the mast 22 and the control rod 32 set accordingly and the spar 12 controlled to rotate on the hull 60 in a desired angle with respect to the prevailing wind in known manner.

Figure 7:
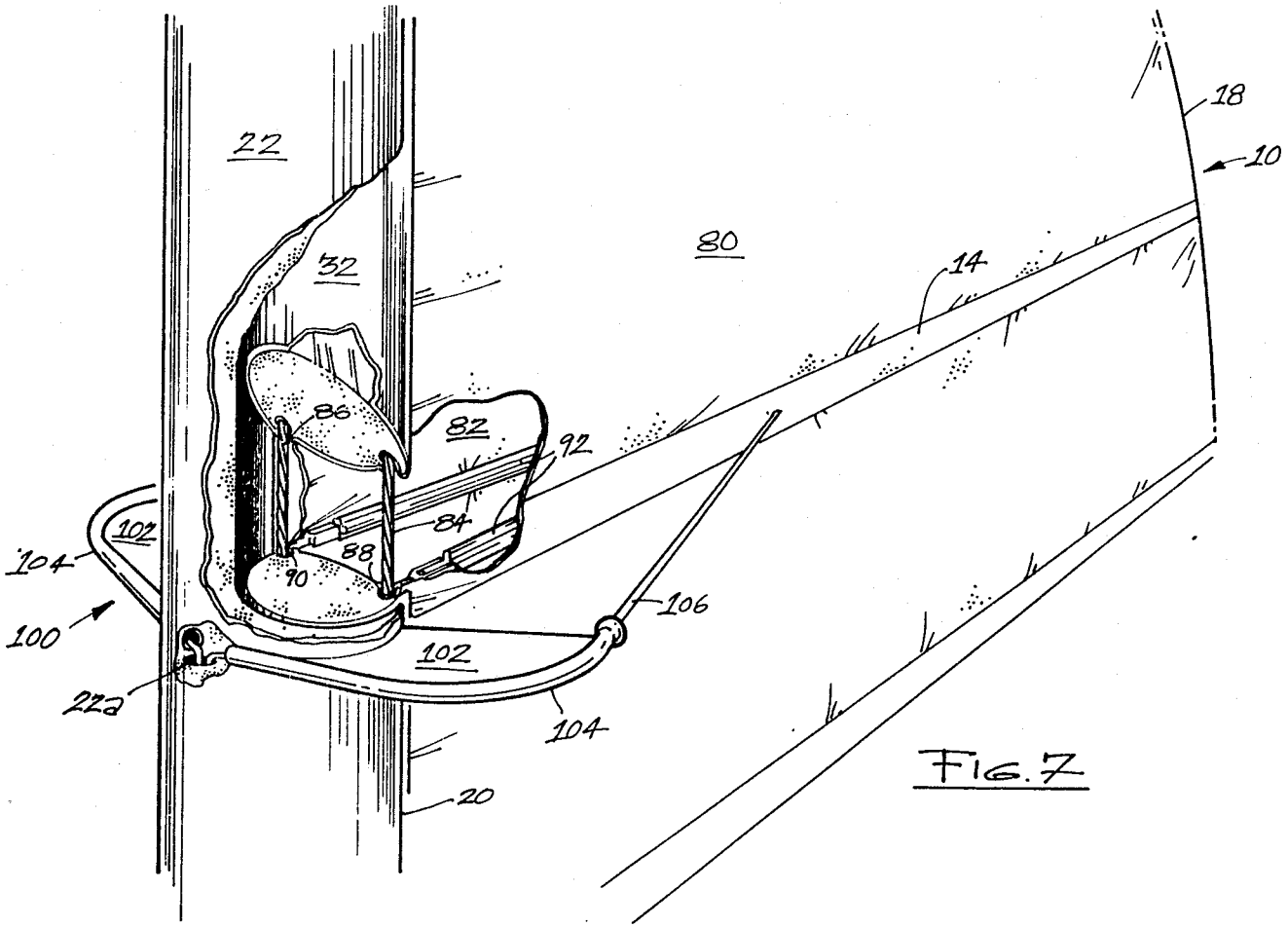
FIG. 7 is a part cut away upper perspective view of the sail and spar of FIG. 1 shown including winglettes.

The sail 10 comprises two flexible sail portions 80 and 82 one of which may be seen in FIGS. 1 and 1a and both of which may be seen in FIGS. 2a, 2b and 7. The two sail portions 80 and 82 are connected at the leach 18 and extend substantially side by side toward the mast 22.

The two sail portions 80 and 82 comprise luff cords 84 and 86 respectively which are arranged to be threaded into corresponding cord tracks 88 and 90 in the control rod 32, as shown in FIG. 7. The resultant shape of the sail 10 is as shown in FIGS. 1b and 2a.

The two sail portions 80 and 82 give the sail 10 an effective thickness which is substantially greater than the thickness of either of the sail portions 80 and 82 individually.

The sail portions 80 and 82 are each stiffened by battens 92, shown in FIGS. 2a, 2b and 7 located in the pocket means 14.

Each of the battens 92 comprises two substantially identical batten portions which are arranged to be connected at the leach 18 and are splayed apart and extend, in use, in the same general direction towards the luff cords 84 and 86.

The batten portions of each batten 92 are, in use, inserted into respective pocket means 14 of the sail portions 80 and 82 with free ends of the splayed apart portions located adjacent the control rod 32. The free ends are connected to the control rod 32 by batten pockets in known manner.

The splayed out extent of the batten portions result in an outward bias when they are inserted in the pocket means 14. The outward bias of the batten portions holds the sail portions 80 and 82 apart and gives the sail 10 a substantially three dimensional aspect.

The width of the erected sail 10 tapers toward the top of the mast 22.

Preferably, the sail portions 80 and 82 are formed of relatively high tensile sail cloth so that in use there is relatively little stretch in the sail 10. The inflexibility is desired to move readily to enable the sail 10 to be controlled to a desired asymmetric aerofoil shape.

The sail 10 is secured at its clew to a stern portion of the boom 24 and either to a forward portion of the boom 24 or to the control rod 32.

The foot 16 of the sail 10 is allowed two dimensional freedom so that the sail portions 80 and 82 between the tack and the clew of the sail 10 can deform to an aerofoil contour. Thus, an aerofoil contour may be produced along the length of the sail 10.

As shown in FIG. 1 the mast 22 comprises a plurality of winglettes 100 toward the mast head 35a. Each of the winglettes 100 comprise webs 102 extending substantially at right angles from the mast 22 as shown in FIGS. 3 and 7.

The winglettes 100 also each comprise relatively short tubes 104 fixed to an outer edge of the webs 102 and connected at a first end to the tube 22a. At a second end remote from the first end the tubes 104 are directed backwardly toward the sail 10.

The tubes 104 are arranged to receive a cord 106 fixed to each of the sail portions 80 and 82 as shown in FIG. 7 and passing into the tube 22*a* and down the mast 22. The cords 106 are intended to be operated to control the amount of lay off in the upper reaches of the sail 10. It has been found that under certain conditions, such as light winds, the upper reaches of the sail 10 may kick up to windward and hence reduce the drive of the sail 10. It has further been found that some lay off is preferred since the wind direction over the length of the sail 10 (height of the mast 22) is not the same due to the requirement of continuity of flow of fluids at the boundary of the air and the water. That is toward the mast head 35*a* the wind direction less obtuse, for example when sailing on a beat.

It is envisaged that a cover means 70 could be attached to the sides of the mast 22 and extending backwardly over a part of the sail 10 adjacent the control rod 32 to provide a relatively smooth substantially continuous surface for air to flow over and onto the sail 10. Thus, turbulance may be reduced about the mast 22 and the overall efficiency of the aerofoil increases.

In use, the rigging of the present invention is fitted to the sailing vessel 8, such as, for example an 18 foot skiff. The sail 10 and the spar 12 of the rigging are particularly envisaged to replace conventional sails and spars for sailing vessels.

The sail 10 is intended to be trimmed by the spar 12 and the control means 38 to an asymmetric aerofoil shape which has variable thickness and variable camber. To erect the sail 10 the battens 92 are inserted and secured into the pocket means 14 in known manner. The luff cords 84 and 96 are next threaded into the cord tracks 88 and 90 and raised up the control rod 32 and the tack of the sails 10 secured to the control rod and the clew of the sails 10 secured to the boom 24.

The cords 106 are tensioned to exert a tensioning bias on the leeward one of the battens 92 toward the mast head 35*a*. The amount of tension required is dependent upon the sailing conditions. Light sailing conditions require more tension in the cords 106 to produce a greater lay off in the top of the sail 10.

Once the sail 10 is hoisted the control means 38 is adjusted to set the angle of rotation of the control rod 32 and the mast 22. The degree of rotation of the lever 40 in relation to the boom 24 sets the size of the asymmetric aerofoil that the sail 10 forms. Large rotations produce relatively thick asymmetric aerofoils. As the lever 40 is rotated the windward batten 92 is placed in tension and the leeward batten 92 is placed in compresion.

The bending of the battens 92 distorts the sail 10 into a substantially asymmetric aerofoil shape and leads to a difference in the path length for air cut by the mast 22. That is, air travelling over the leeward batten 92 must travel further and so move faster than air travelling over the windward batten portion, for the conditions of FIG. 2*b*.

The different speeds create a pressure gradient across the sail 10 aerofoil which then drives the vessel forwardly.

The amount of forward propulsion attainable is dependent on the width of the aerofoil and the difference in the path lengths. That is, the degree of rotation of the lever 40 and hence the control rod 32 sets the amount of drive that the sail 10 has. For example, a small degree of rotation yields a small aerofoil, that is an aerofoil of small cross-sectional dimensions.

The degree of rotation which is intended to be used depends on the sailing conditions. For example, in heavy sailing conditions the degree of rotation of the control rod 32 may be small to create a small aerofoil with relatively little drive. Whereas in light sailing conditions the degree of rotation of the control rod 32 may be large to create a larger aerofoil with a relatively large drive.

When the sailing vessel 8 is to be tacked the cord in the series of pulleys is operated to move the lever 40 from a degree of rotation toward one side of the vessel 8 to a similar degree of rotation toward the other side of the vessel 8. That is, when sailing on a port tack the lever 40 is set at a degree of rotation toward the port side with respect to the boom 24. Then, upon tacking to a starboard board the lever 40 is rotated to a similar degree of rotation toward the starboard side.

It is envisaged that the rigging 9 of the present invention could be adapted for use with a sail being a headsail.

It is also envisaged that the rigging 9 of the present invention could be adapted for use as a horizontal asymmetric aerofoil such as in an aeroplane or an ultralight aircraft for example.

Modifications and variations such as would be apparent to a skilled addressee are deemed within the scope of the present invention. For example, a number of pairs of battens 92 other than 8 could be used.

What is claimed is:

1. Rigging for a wind propelled craft comprising: a sail comprising two substantially identical flexible sail portions each having a leach and a luff and a foot, each of said leach and said foot being joined at a clew and said leaches of said flexible sail portion being attached together, said sail portions each having a variable camber; a plurality of elongated battens each having flexure in at least two dimensions, each of said elongated battens comprising two batten portions one of which is disposed in contact with one of said sail portions and the other of which is disposed in contact with the other of said sail portions; a spar comprising a boom and a control rod, said control rod being arranged to be disposed upright and rotatable upon said wind propelled craft, said boom being rotatably attached to said control rod and having said clew of each of said sail portions attached to said boom remotely of said control rod, said control rod having said batten portions of each of said elongated battens and said luff of each of said sail portions pivotally attached to said control rod in spaced apart manner so that a perpendicular distance between said two sail portions adjacent said control rod may be varied; and a control means comprising a lever fixed in rotation with said control rod, said lever being capable of angularly displacing said control rod with respect to the boom; said sail portion and said elongated battens and said spar forming an aerofoil having a leading edge adjacent the spar and a trailing edge adjacent the leaches of said sail portions, such that angular displacement of the control rod with respect to the boom causes said batten portions in contact with one of said sail portions to be compressed along their length so as to bend said one of said sail portions to increase the camber thereof while causing said batten portions in contact with the other one of said sail portions to be tensioned along their length so as to tend to partly straighten the other one of said sail portions to reduce the camber thereof which decreases the perpendicular distance between said two sail portions adjacent said control rod, the respective bending and straightening of said sail portions resulting in asymmetry of the aerofoil and the spaced apart attachment of luffs to said control rod producing thickness in the aerofoil, said asymmetry and thickness of the aerofoil being dependent on the angular displacement of said lever with respect to the boom.

2. Rigging for a wind propelled craft according to claim 1, in which said control rod has a thickness which is less than the thickness of the aerofoil.

3. Rigging for a wind propelled craft according to claim 1, in which said control rod is rotated with respect to said boom toward said sail portion being bent and away from said sail portion being partly straightened.

4. Rigging for a wind propelled craft according to claim 1, in which said spar comprises a mast having a leading edge and a trailing edge defining a concave surface, said mast and said control rod being rotatably connected such that said concave surface of said mast receiving at least part of said control rod, said mast being rotatably supported upon said wind propelled craft, said control means comprising means connected between said control rod and said mast to rotate said mast oppositely to the rotation of said control rod with respect to said boom such that the leading edge of the mast is directed substantially in line with said sail.

5. Rigging for a wind propelled craft according to claim 4, in which said mast comprises a plurality of winglettes located adjacent said sail portions toward a top of said mast, said winglettes comprising webs disposed substantially at right angles to said mast, a relatively short tube fixed to an outer edge of each of said webs and connected at a first end to a relatively long tube located within said mast and adjacent the leading edge of said mast, a second end remote from the first end and directed backwardly toward said sail, said relatively short tube receiving a cord coupled at one end to one of said sail portions, said cord threaded through said relatively long tube and arranged to be tensioned to vary the lay off of said sail.

* * * * *